US007967474B2

(12) United States Patent
Ghim et al.

(10) Patent No.: US 7,967,474 B2
(45) Date of Patent: Jun. 28, 2011

(54) LED ILLUMINATION DEVICE AND RADIATING MEMBER OF LED ILLUMINATION DEVICE

(75) Inventors: Joong El Ghim, Gyeonggi-do (KR); Kyung Ho Lee, Gyeonggi-do (KR)

(73) Assignee: Samsung LED Co., Ltd., Gyunggi-do (KR)

( * ) Notice: Subject to any disclaimer, the term of this patent is extended or adjusted under 35 U.S.C. 154(b) by 0 days.

(21) Appl. No.: 12/149,476

(22) Filed: May 2, 2008

(65) Prior Publication Data

US 2009/0225555 A1 Sep. 10, 2009

(30) Foreign Application Priority Data

Mar. 6, 2008 (KR) ..... 10-2008-0020936

(51) Int. Cl.
*F21V 29/00* (2006.01)

(52) U.S. Cl. ..... 362/294; 362/373

(58) Field of Classification Search ..... 362/547, 362/264, 294, 373, 218, 249.02, 345; 361/679.47, 361/679.54, 696–697
See application file for complete search history.

(56) References Cited

U.S. PATENT DOCUMENTS 5,927,386 A 7/1999 Lin
2007/0253202 A1* 11/2007 Wu et al. ..... 362/294
2007/0285926 A1* 12/2007 Maxik ..... 362/294
2008/0186704 A1* 8/2008 Chou et al. ..... 362/249
2009/0027889 A1* 1/2009 Kang et al. ..... 362/294
2009/0135604 A1* 5/2009 Chen ..... 362/294

FOREIGN PATENT DOCUMENTS

CN 2881340 Y 3/2007
CN 201028326 Y 2/2008
KR 10 0754405 B1 8/2007
KR 10-0756897 B1 9/2007
KR 10-0759803 B1 9/2007

OTHER PUBLICATIONS

Chinese Office Action, w/ English translation thereof, issued in Chinese Patent Application No. CN 200810094753.8 dated May 12, 2010.

* cited by examiner

*Primary Examiner* — Julie A Shallenberger
(74) *Attorney, Agent, or Firm* — McDermott Will & Emery LLP

(57) ABSTRACT

The present invention relates to a radiating member of an LED illumination device and the LED illumination device using the same. Provided is an LED illumination device includes a printed circuit board mounted with LED chips; and a radiating member provided on a rear surface of the printed circuit board, wherein the radiating member includes a radiating pipe vertically attached to a center of the printed circuit board, radiating pins surrounding and attached to the printed circuit board at a predetermined interval, radiating disks provided below the radiating fins and arranged along the radiating pipe at a predetermined interval, and a radiating member case for covering the radiating member.

10 Claims, 2 Drawing Sheets

[FIG. 1]
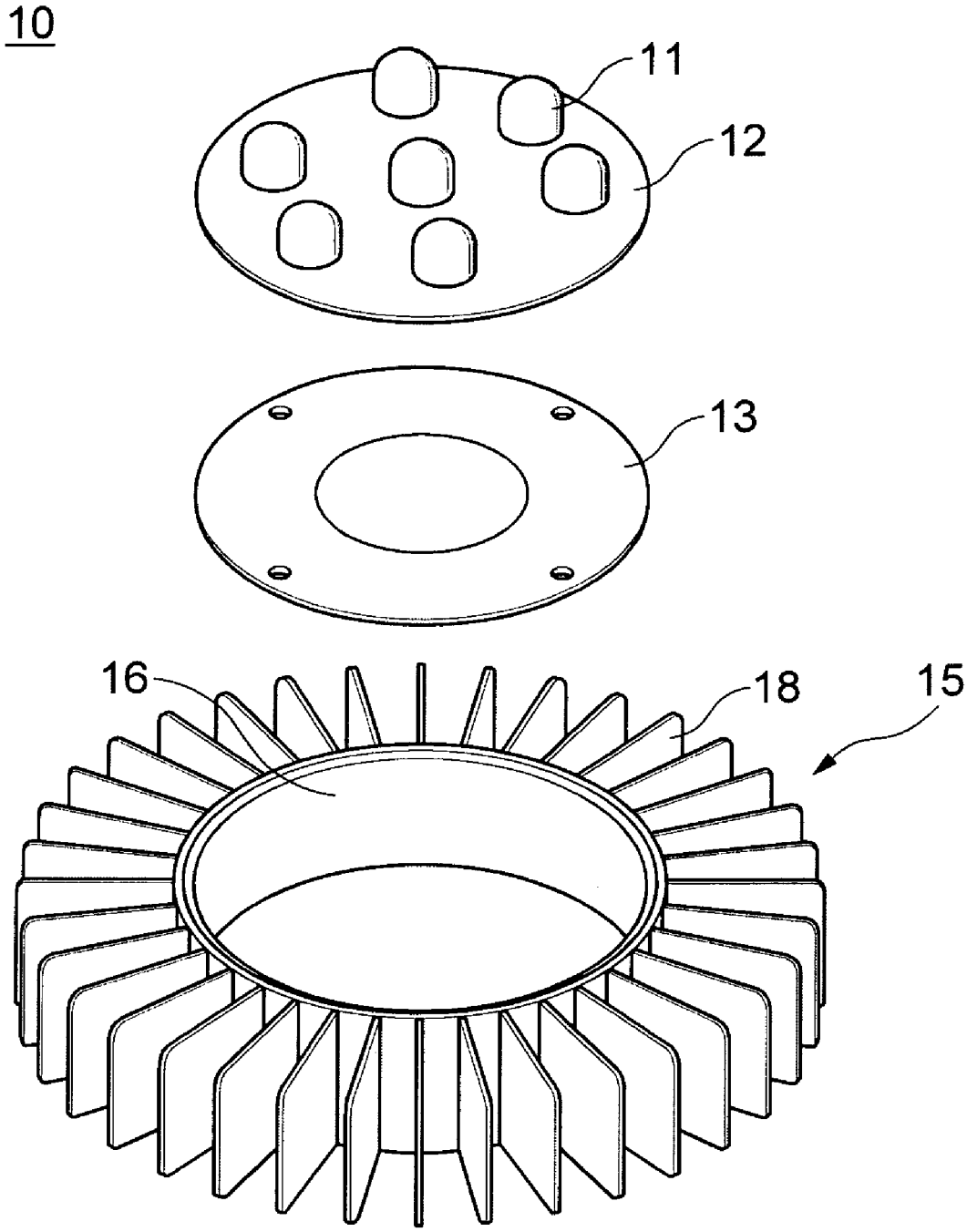
- Prior Art -

[FIG. 2]
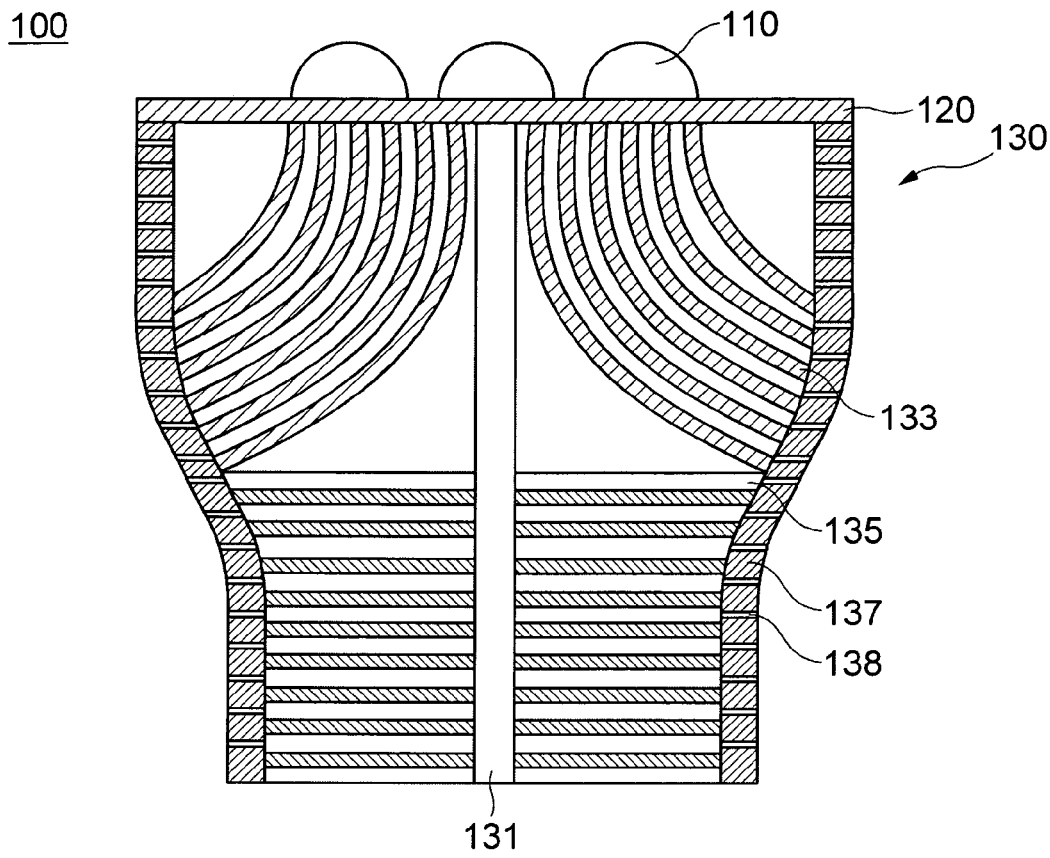
[FIG. 3]
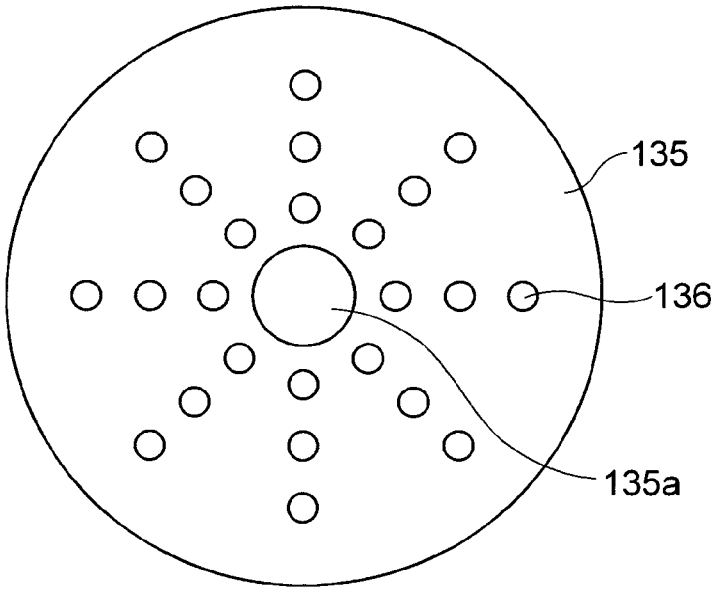

LED ILLUMINATION DEVICE AND RADIATING MEMBER OF LED ILLUMINATION DEVICE

CROSS-REFERENCE TO RELATED APPLICATIONS

This application claims the benefit of Korean Patent Application No. 10-2008-0020936 filed with the Korea Intellectual Property Office on Mar. 6, 2008, the disclosure of which is incorporated herein by reference.

BACKGROUND OF THE INVENTION

1. Field of the Invention

The present invention relates to an LED illumination device; and more particularly, to an LED illumination device having a good radiation effect and an excellent visual effect by being provided with a plurality of radiating fins and a case covering the radiating fins.

2. Description of the Related Art

An LED (Light Emission Diode) element represents an element emitting predetermined light through the recombination of a minority of carriers (electrons and holes) after generating the carriers injected by using a p-n junction structure of a semiconductor. The LED element includes a red LED element using GaAsP, a green LED element using GaP, and a blue LED element using an InGaN/AlGaN double hetero structure.

The LED element has low power consumption and a long lifetime, and a vibration resistance characteristic. The LED element can be installed in a narrow space. The LED element has been used as a display element and a back light. Recently, the LED element has been actively researched and developed so as to be applied for a general illumination apparatus.

However, only 20% of energy inputted into an LED illumination lamp is converted into the light and the rest 80% of the inputted energy is converted into heat in a junction portion according to a light generation characteristic of an LED lamp, thereby increasing an internal temperature. The increment of the internal temperature substantially degrades a performance of the LED illumination lamp.

That is, the efficiency of the LED illumination lamp is curtailed by the emission of the heat at the time of using the LED illumination lamp for a predetermined time and a heating value of the LED illumination lamp increases at the time of using the illumination lamp for a long time, thereby curtailing a lifetime of the LED illumination lamp.

Accordingly, in order to preventing the curtailment of the lifetime of the LED illumination lamp due to the long-term usage and the excessive heat emission of the LED illumination lamp, the heat generated in the inside of the LED lamp needs to be discharged to the outside.

Particularly, in case of a high-output LED lamp, since LED chips are densely integrated in the narrow space, a rapidly increasing temperature in the junction portion needs to be effectively radiated.

In prior art, a method of cooling the heat of the LED lamp by convection by means of a radiator having a radiating fin structure was used so as to discharge the heat of the LED lamp.

FIG. 1 shows an LED illumination device provided with a radiator having a conventional radiating fin structure.

As shown in FIG. 1, a conventional LED illumination device 10 includes a printed circuit board 12 mounted with a plurality of LED chips 11 and a radiator 15 provided on the other surface of the printed circuit board 12 on which the LED chips 11 are not mounted.

The radiator 15 includes a radiating plate 13 mounted with the printed circuit board 12 and radiating fins 18 provided below the radiating plate 13. The radiating fins 18 radially protrude on an outer circumference surface of a cylindrical support 16.

The cylindrical support 16 is mechanically joined with the radiating plate 13.

In the above-configured conventional LED illumination device 10, when a signal is applied to the printed circuit board 12, light and heat is generated from the LED chips 11 at once. The heat generated from the LED chips 11 is transmitted to the radiating plate 13 and the light transmitted to the radiating plate 13 is transmitted to the radiating fins 18 through the cylindrical support 16 provided below the radiating plate 13. The light transmitted to the radiating fins 18 is radiated by natural convection.

As described above, the conventional LED illumination device 10 discharges the heat through the radiating fins 18. At this time, since the larger the surface areas of the radiating fins 18 is, the better a radiation effect is, the radiating fins 18 protrude radially to run outward from the cylindrical support 16.

As described above, there is an advantage in that the radiation effect can be raised at the time of radially form the radiating fins 18, but since the radiating fins 18 are exposed to the outside, the LED radiation lamp has a dirty exterior and has a low visual effect.

SUMMARY OF THE INVENTION

Accordingly, the present invention is made to solve the above-mentioned problem and an advantage of the present invention is that it provides an LED illumination device having a good visual effect by being provided with a case for covering radiating fins in the outside of the radiating fins.

Another advantage is that it provides an LED illumination device provided with an entrance hole in the case for covering the radiating fins so as to radiate heat smoothly.

In order to achieve the above-mentioned advantages, according to an aspect of the invention, an LED illumination device includes a printed circuit board mounted with a plurality of LED chips; and a radiating member provided on a rear surface of the printed circuit board, wherein the radiating member includes a radiating pipe vertically attached to a center of the printed circuit board; radiating pins which surround and are attached to the printed circuit board at a predetermined interval, radiating disks which are provided below the radiating fins and are arranged along the radiating pipe at a predetermined interval, and a radiating member case for covering the radiating member.

A plurality of holes are formed on the radiating disk and serve to increase heat conductivity by natural convection.

The holes are also formed in the radiating member case. The holes allow the heat to be smoothly radiated through the air entrance holes. The radiating member case is in contact with the radiating fins.

The radiating pipe may be composed of a heat pipe or may be made of metallic materials having high heat conductivity, such as Al and Cu. The radiating fins, the radiating disks, and the radiating member case are also made of the metallic materials having the high heat conductivity, such as Al and Cu.

According to another aspect of the invention, an LED illumination device includes a plurality of LED chips mounted on a printed circuit board and a radiating member provided on a rear surface of the printed circuit board. The radiating member includes a radiating pipe; horn-shaped radiating fins which surround the radiating pipe and are arranged on the printed circuit board at a predetermined interval; disk-shaped radiating disks which are provided below the radiating fins and are arranged along the radiating pipe at a predetermined interval; and a radiating member case which covers the radiating member and is in contact with the radiating fins.

The radiating member is made of a metallic material having high heat conductivity and for example, may be made of Al or Cu.

The radiating pipe may be composed of a heat pipe.

The holes are formed on the radiating disks to improve a radiation effect and the holes are formed in the radiating case to further enhance the radiation effect.

As described above, the present invention provides the LED illumination device provided with the radiating member case. The present invention has an advantage in that the radiation effect can be improved by forming the holes in the radiating member case to allow the air to be smoothly circulated and a visual effect can be enhanced by covering the radiating fins with the radiating member case.

As described above, in the present invention, the case for covering the radiating member constituted of the radiating fins, the radiating disks, and the like to improve the visual effect. All the LED illumination devices provided with the radiating member case belong to the present invention regardless of a shape of the radiating member, for example, the radiating fin.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIG. 1 is a diagram showing a configuration of a conventional LED illumination device;

FIG. 2 is a cross-sectional view of an LED illumination device according to the invention; and FIG. 3 is a plan view of a radiating disk.

DETAILED DESCRIPTION OF THE PREFERRED EMBODIMENTS

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

Hereinafter, an LED illumination device according to the present invention will be described in detail with reference to the accompanying drawings.

FIG. 2 is a cross-sectional view of the LED illumination device according to the invention.

As shown in the figure, the LCD illumination device 100 includes a plurality of LED chips 110 which generate light, a circuit board 120 in which a circuit supplying power to the LED chips 110 is arranged, and a radiating member 130 which is installed on a rear surface of the circuit board 120 and radiates heat generated from the LED chips 110 to the outside.

At this time, the LED illumination device 100 may further include a reflecting heat which is provided above the LED chips 110 and reflects the light so as to improve light extracting efficiency and uniformly irradiating the light generated from the LED chips 110 generally by reflecting the light generated from the LED chips 110 to change an irradiation direction of the light.

The radiating member 130 includes a radiating pipe 131, radiating fins 133, and radiating disks 135. A radiating member case 137 for covering the radiating member 130 is additionally provided.

The heat radiating pipe 131 is vertically formed in a center of the printed circuit board 120. The heat radiating pipe 131 may be attached to the printed circuit board through an adhesive.

The heat radiating pipe 131 may be composed of a heat pipe or may be made of a metallic material having high heat conductivity, such as Al or Cu.

The radiating fins 133 have a horn shape along the periphery of the radiating pipe 131 and are constituted in plural. The radiating fins 133 have the horn shape at a predetermined interval and are formed on the rear surface of the printed circuit board 120. The radiating fins 133 may be attached onto the rear surface of the printed circuit board 120.

Meanwhile, the radiating fins 133 are made of the metallic material having the high heat conductivity and for example, the radiating fins 133 may be made of the metallic material such as Al or Cu.

The radiating disks 135 are provided below the radiating fins 133 in a disk shape. The radiating disks 135 are constituted in plural and are arranged on the radiating pipe 131 at a predetermined interval.

The radiating disks 135 are made of the metallic material having the high heat conductivity, such as Al or Cu, like the radiating fins 133.

The radiating member case 137 covers both the radiating fins 133 and the radiating disks 135. Particularly, the radiating member 137 is in contact with the radiating fins 133. At this time, the radiating member case 137 may be in contact with the radiating disks 135 and is made of the metallic material having the high heat conductivity, such as Al or Cu, like the radiating disks 135.

Meanwhile, a plurality of holes 138 are provided in the radiating member case 137 and the heat transmitted to the printed circuit board 120 from the LED chip 110 is discharged to the outside through the holes 138.

Moreover, the plurality of holes are also formed in each of the radiating disks 135 and air is circulated in the inside of the radiating member 137 by the holes formed in the radiating disk 135.

FIG. 3 is a plan view of the radiating disk for showing the holes formed in the radiating disk.

As shown in FIG. 3, a through-hole 135*a* for inserting the radiating pipe 131 is provided in a center of the radiating disk 135 and a plurality of holes 136 for circulating the air in the inside of the radiating member case 137 are formed in the periphery of the radiating disk 135.

The above-configured radiating member 130 according to the invention effectively discharges the heat generated from the LED chips 110 by heat conduction and natural convection.

That is, when the heat generated from the LED chips 110 is transmitted to the printed circuit board 120, the heat transmitted to the printed circuit board 120 is discharged to the outside through the radiating fins 133, the radiating pipe 131, the radiating disks 135, and various paths of the radiating member case 137 for covering them. At this time, some of the heat is radiated by the transmission of the heat to the radiating member 130 and others are directly discharged to the outside through the holes 136 and 138) formed in the radiating member case 137 and the radiating disks 135.

In other words, in the present invention, since the radiating members (the radiating fins, the radiating pipe, the radiating disks, and the radiating member case) are made of the metallic material having the high heat conductivity, the heat is effectively transmitted to the radiating member 130.

The heat transmitted through the printed circuit board 120 can be effectively discharged by the radiating fins 133 and the radiating disks 135 and by circulating external air flowing into the inside of the LED illumination device through the plurality of holes 138 formed in the radiating member case 137.

As described above, in the present invention, a good visual effect for the radiating member of the LED illumination device can be acquired by additionally providing the case for covering the radiating member. In particular, the visual effect and a radiation effect can be improved by making the radiating member case of the metallic material having the high heat conductivity, such as the radiating member and by punching the holes for circulating the air.

As described above, according to the present general inventive concept is to improve the visual effect by making the radiating member case for covering the radiating member of the LED illumination device of the same material as the radiating member and to enhance the radiation effect by forming the holes for allowing the air to flow in and out. All the LED illumination devices provided with the radiating member case having the air entrance belong to the present invention regardless of a shape and a structure of the radiating fins, the radiating disks, or the radiating pipe.

The LED illumination device according to the present invention has a neat exterior by additionally providing the radiating member case for covering the radiating member, thereby improving a visual effect.

Further, the radiation effect is further improved by providing the air entrance in the radiating member case to allow the heat to be smoothly radiated.

Therefore, it will be appreciated by those skilled in the art that changes may be made in these embodiments without departing from the principles and spirit of the general inventive concept, the scope of which is defined in the appended claims and their equivalents.

What is claimed is:

1. An LED (Light Emission Diode) illumination device comprising:

a printed circuit board mounted with LED chips; and a radiating member provided on a rear surface of the printed circuit board, wherein the radiating member includes:

a radiating pipe vertically attached to a center of the printed circuit board;

a plurality of horn-shaped radiating fins surrounding the radiating pipe, the plurality of horn-shaped radiating fins being disposed concentrically in a radial direction and extending outwardly from the radiation pipe, and an end part of each of the horn-shaped radiating fins being attached directly to the rear surface of the printed circuit board;

radiating disks which are provided below the radiating fins and are arranged along the radiating pipe at a predetermined interval; and a radiating member case for covering the radiating fins and the radiating disks, wherein holes are formed on the radiating disks.

2. The LED illumination device according to claim 1, wherein holes are formed in the radiating member case.

3. The LED illumination device according to claim 1, wherein one sides of the radiating fins are in contact with the radiating member case.

4. The LED illumination device according to claim 1, wherein the radiating pipe is made of a heat conductive material.

5. The LED illumination device according to claim 4, wherein the radiating member is made of Al or Cu.

6. A radiating member of an LED illumination device including a plurality of LED chips mounted on a printed circuit board, the radiating member comprising:

a radiating pipe;

a plurality of horn-shaped radiating fins surrounding the radiating pipe, the plurality of horn-shaped radiating fins being disposed concentrically in a radial direction and extending outwardly from the radiation pipe, and an end part of each of the horn-shaped radiating fins being attached directly to a rear surface of the printed circuit board;

disk-shaped radiating disks which are provided below the radiating fins and are arranged along the radiating pipe at a predetermined interval; and a radiating member case which covers the radiating fins and the radiating disks, and is in contact with the radiating fins, wherein holes are formed on the radiating disks.

7. The radiating member of the LED illumination device according to claim 6, wherein the radiating pipe is composed of a heat pipe.

8. The radiating member of the LED illumination device according to claim 6, wherein the radiating pipe, the radiating fins, and the radiating member case are made a heat conductive metallic material.

9. The radiating member of the LED illumination device according to claim 8, wherein the heat conductive metallic material is made of Al or Cu.

10. The radiating member of the LED illumination device according to claim 6, wherein holes are formed in the radiating member case.

* * * * *